United States Patent [19]

Ishida

[11] 3,937,252

[45] Feb. 10, 1976

[54] IMPULSE SIGNAL PRODUCING DEVICE OF THE PNEUMATIC PRESSURE TYPE

[75] Inventor: Takashi Ishida, Ohi, Japan

[73] Assignee: Mikuni Kogyo Co., Ltd., Tokyo, Japan

[22] Filed: Dec. 2, 1974

[21] Appl. No.: 528,624

[52] U.S. Cl. ..... 137/624.13; 137/625.47

[51] Int. Cl.[2] ..... F15C 3/16

[58] Field of Search..... 137/624.13, 624.15, 624.18, 137/624.2, 625.47, 83, 624.14, 625.11

[56] References Cited

UNITED STATES PATENTS

| | | | |
|---|---|---|---|
| 2,851,648 | 9/1958 | Reger | 137/625.47 X |
| 3,469,602 | 9/1969 | Wiley | 137/624.2 |

*Primary Examiner*—Alan Cohan

*Attorney, Agent, or Firm*—Andrus, Sceales, Starke & Sawall

[57] ABSTRACT

The impulse signal producing device comprises a rotatable sleeve which has several small holes and/or slots, a supply body which is formed with air ejecting openings at positions inside the rotating paths of the small holes and/or slots, and a receiving cover which is formed with output ports at positions corresponding to the air ejecting openings. The slot is extended in the circumferential direction of the rotatable sleeve, and one end of the slot in the rotating direction is arranged on the same generating line of the rotatable sleeve as that including the position of the small hole. Air ejected from the openings passes through the small hole and slot of the rotatable sleeve and flows out of the output ports, to produce output pulses. By varying the length of the slot in the circumferential direction, the pulse width can be varied. By varying the arrangement of the small holes and slots, it is possible to vary the phases of the output pulses or to produce several pulses at the same time.

3 Claims, 3 Drawing Figures

IMPULSE SIGNAL PRODUCING DEVICE OF THE PNEUMATIC PRESSURE TYPE

This invention relates to an impulse signal producing device of the pneumatic pressure type.

Heretofore, it has been customary to employ pneumatic pressure to prepare various signal circuits for use as control means. A fluidics circuit has often been used in a control or measuring circuit. In some of such cases, it is desired to give fluidics the output of a shaft to thus generate impulses proportional to the number of revolutions, and to use them as the input or bias signal of a control circuit or calculating circuit.

U.S. Pat. No. 3,651,824 discloses an approximate impulse signal producing device of the pneumatic pressure type comprising a casing, a rotor supported in said casing and formed on its outer peripheral surface with a surface inclined with respect to the direction of rotation of the rotor, a pressure supply duct provided in said casing for ejecting an air jet under pressure to said inclined surface of the rotor, a drain provided in said casing in a position substantially symmetrical to the position of said pressure supply duct, and an output duct provided in said casing and disposed substantially midway between said pressure supply duct and said drain. With such device, however, when it is intended to derive different sorts of pulses in large numbers, the diameter of a pulse producing disc becomes large and accordingly the whole device becomes considerably large. As the disc is thinner, it is better in the efficiency of transmitting the air flow. In this respect, when the thickness is made small, the disc undergoes a large deflection because the pressure on the supply side acts on the whole area of the disc. In anticipation of the deflection, some extent of clearance (for example, approximately 1/10mm or greater) must be provided in the disc rotating section. Due to the provision of the clearance, the pressure recovery rate at output ports lowers, and the pulse waveform is not very good. Besides, the thrust of the drive shaft increases, and the countermeasure need be taken by providing thrust washers and thrust bearings. When, as described above, the jet for pulses is supplied in the axial direction and the output pulses are derived in the same direction, the pulse producing device has the following disadvantages.

1. The diameter of the whole device becomes large.
2. Since the device is subjected directly to the thrust ascribable to the supply pressure, the countermeasure is necessary.
3. Unless the supply pressure is raised and simultaneously the air exhaust through an air vent is increased, pulses of good waveform cannot be acquired. For this reason, the air consumption is inevitably large.
4. Vibrational noises are caused by the deflection of the rotary disc.

According to this invention, at least one small hole or circumferential slot is provided in the surface of a rotary drum with one end opened, and the jet of supply air introduced into the rotary sleeve is ejected in the radial direction of a shaft, so that output pulses are taken out of output ports at the outer periphery of the drum. Owing to such construction, when the small hole and the slot of the rotary sleeve are shifted in arrangement, pulses having a phase shift can be produced. Further, by providing the small holes or slots at different positions on a generating line of the rotary sleeve, several sorts of output pulses can be easily produced at the same time. When the circumferential lengths of the slots are made different, the time widths of the pulses vary. It is desirable that the output ports are usually maintained under the condition of the atmospheric pressure, and that when they receive the jet, the pulse output of good waveform is provided. To this end, a supply body which is provided with openings in proximity to the inner surface of the rotary sleeve and along the rotating course of the small hole or slot is built in. Thus, output pulses of good pressure recovery rate can be produced.

An object of the present invention is to provide a device for producing output pulses of good pressure recovery rate.

Another object of the present invention is to provide a device for positively producing by mechanical means approximate impulse wave forms to be used as trigger signals.

The device of the aforementioned nature according to this invention permits to produce approximate impulse signals of any width as desired and to deliver them through an output duct. The invention is useful in simplifying circuits in various control apparatus, increasing the dependability of the circuits and reducing the cost of production thereof.

The foregoing objects and advantages of the present invention, together with various other objects and advantages thereof which will become apparent, may be attained with the exemplary embodiment of the invention illustrated in the accompanying drawings and described in detail hereinafter.

Referring to the drawings.

Figure 1:
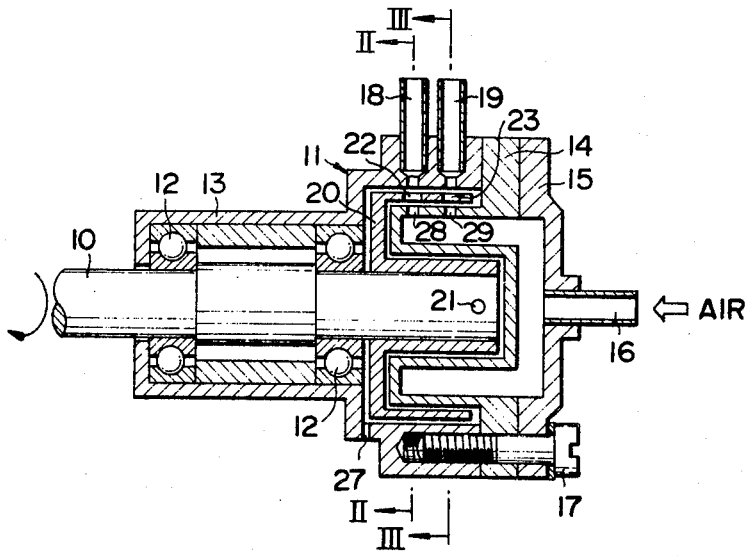
FIG. 1 is a longitudinal sectional view of a device embodying the invention.

FIG. 1 shows a longitidinal section of a pulse producing mechanism. A shaft 10 is supported in a housing portion 13 of a receiving cover 11 through bearings 12, 12. On an end face of the receiving cover 11, a pressure cover 15 having an air supply port 16 is mounted through a supply body 14 and by a set screw 17.

Figure 3:
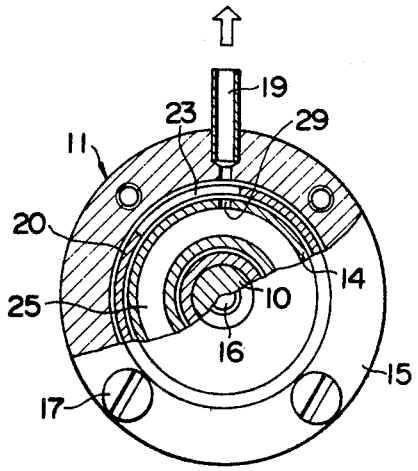
FIG. 3 is an elevational sectional view taken along the arrowed line III — III of FIG. 1.
Figure 2:
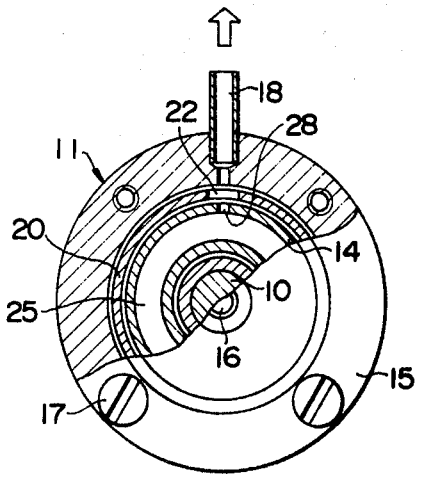
FIG. 2 is an elevational sectional view taken along the arrowed line II — II of FIG. 1.

A rotary sleeve 20 for producing pulses and with its one end opened is secured to an end of the shaft 10 by a pin 21. The sleeve 20 is formed at axially different positions with apertures having different lengths in the circumferential direction thereof, that is, a small hole 22 and a slot 23. At those positons of the receiving cover 11 which are radially outside and close to the small holw 22 and the slot 23, air flow receiving ports or output ports 18 and 19 are oppositely provided. In the illustrated embodiment, the small hole 22 is provided at a position of the rotary drum 20 nearer to the housing 13, while the slot 23 extending in the circumferential direction is provided at a position nearer to the supply body 14. Since one end of the slot 23 and the small hole 22 are located on an identical generating line of the sleeve 20 (refer to FIGS. 2 and 3), output pulses have no phase shift.

As shown in the figures, the supply body 14 has such sectional form that it is substantially in contact with the inner wall of the sleeve 20. It is provided with openings 28 and 29 of predetermined size at positions corresponding to the small hole 22 and the slot 23 of the sleeve 20. A chamber 25 is defined between the supply body 14 and the pressure cover 15. An air vent 27 serving also as a drip hole is provided at a corner part of the receiving cover 11 receiving the rotary drum 20.

The exemplary embodiment is the device in which the small hole and the slot are provided at the axially different positions of the rotary drum and which can produce the in-phase pulses of different pulse widths. Of course, when one series of pulses are to be produced, one small hole or slot may be provided in the rotary drum. Further, when several series of pulses are to be produced, several small holes and/or slots may be provided with or without a phase shift or phase shifts.

In the foregoing device, an air jet is fed from the air supply port 16. Only when, owing to the rotation of the rotary sleeve 20, the air from the openings 28 and 29 of the supply body 14 passes through the small hole 22 and the slot 23 being the apertures of the rotary sleeve 20, it flows into the output ports 18 and 19. Then, the output pulses are produced. Since, in this manner, the air flow fed from the air supply port is ejected in the radial direction of the sleeve, the clearance between the sleeve 20 and the supply body 14 can be made small. The same applies to the clearance between the receiving cover 11 and the rotary sleeve 20. In consequence, air leaking from the supply body 14 and exerting a thrust load on the sleeve 20 is very slight. The thrust is almost negligible. Since the respective clearances are small, the pressure recovery rate of the pulses is good, waveforms as expected are obtainable, and the air consumption is small.

The advantages of this invention are listed below.

1. Even where a large number of series of output pulses are required, only the axial length may be made large without increasing the diameter.

2. In fabricating the rotary sleeve, its diameter can be finished at high precision by lathe working etc. The clearance between the rotary sleeve and the air supply body can therefore be set to be very small (for example, about 3/100 - 5/100mm). Consequently, the acial thrust arises only slightly, and no special measure against the thrust is necessary.

3. Owing to the advantage of the preceding item, good waveforms of the output pulses are achieved. Simultanously therewith, the pressure of the supply air can be set to be low, so that a comparatively small air consumption suffices.

4. Since no thrust acts on the rotary sleeve, no vibration occurs in the axial direction, and almost no noise arises.

What I claim is:

1. An impulse signal producing device of the pneumatic pressure type comprising:

a receiving cover, a pressure cover having an air supply port at its central part and mounted opposite to said receiving cover, a shaft rotatably supported in said receiving cover and having an end, a rotatable sleeve mounted on said shaft and shaped so as to define an open end, a supply body interposed between said receiving cover and said pressure cover and having at least two openings on its circumference, said supply body having a section in the shape of a hat and with a concave central part thereof and mounted on said end of said shaft with a small diameter portion covering the end of said shaft, and said body having said openings in the circumferential surface of a large diameter portion.

a small hole provided in said sleeve in correspondence with one of said openings, a slot provided in said sleeve in correspondence with the other of said openings in said body and extended in the circumferential direction of said sleeve from on the same generating line of said sleeve as passes through said small hole, and output ports formed in said receiving cover in alignment with rotating paths of said small hole and said slot.

2. A device as defined in claim 1, wherein said pressure cover and the supply body define a chamber therebetween.

3. A device as defined in claim 1, wherein said receiving cover has an air vent arranged to also function as a drip hole.

* * * * *

UNITED STATES PATENT AND TRADEMARK OFFICE

CERTIFICATE OF CORRECTION

PATENT NO. : 3,937,252

DATED : February 10, 1976

INVENTOR(S) : TAKASHI ISHIDA

It is certified that error appears in the above-identified patent and that said Letters Patent are hereby corrected as shown below:

| | | | | |
|---|---|---|---|---|
| Column | 2, | Line | 54, | after "small" cancel "holw" and insert --- hole ---; |
| Column | 3, | Line | 42, | at the end of the line, cancel "acial" and insert --- axial ---; |
| Column CLAIM 1 | 4, | Line | 28, | after "portion" cancel the Period (.) and insert --- a comma (,) ---; |

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*